United States Patent [19]

Gehauf nee Kiesel et al.

[11] 4,165,620

[45] Aug. 28, 1979

[54] SELF-SERVICE COOLING CABINET

[75] Inventors: Liselotte Gehauf nee Kiesel, Munich; Heinrich Eberhardt, Schwaig; Rolf W. Gailing, Nüremberg, all of Fed. Rep. of Germany

[73] Assignee: Ludwig Kiesel oHG, Nüremberg, Fed. Rep. of Germany

[21] Appl. No.: 894,857

[22] Filed: Apr. 10, 1978

[30] Foreign Application Priority Data

Apr. 12, 1977 [DE] Fed. Rep. of Germany ... 7711392[U]

[51] Int. Cl.[2] ..... A47F 3/04

[52] U.S. Cl. ..... 62/256

[58] Field of Search ..... 62/256

[56] References Cited

U.S. PATENT DOCUMENTS

| | | | |
|---|---|---|---|
| 2,984,085 | 5/1961 | Rainwater | 62/256 |
| 3,304,736 | 2/1967 | Brennan et al. | 62/256 |
| 3,698,205 | 10/1972 | Perez | 62/256 |
| 3,756,038 | 9/1973 | MacMaster et al. | 62/256 |
| 3,812,684 | 5/1974 | Brown | 62/256 |

FOREIGN PATENT DOCUMENTS

| | | | |
|---|---|---|---|
| 2230159 | 12/1974 | France | 62/256 |

*Primary Examiner*—Lloyd L. King
*Attorney, Agent, or Firm*—Becker & Becker, Inc.

[57] ABSTRACT

A self-service low temperature cooling cabinet for easily spoilable food and/or edible products, especially ice cream, with an easily accessible front withdrawing opening and two cooling units or groups of cooling units comprising a ventilator and an evaporator. These cooling units or groups of cooling units convey the cooling air in a circuit over the goods to be cooled and subsequently again to the evaporators of the cooling units or group of cooling units. Above and below a display chamber confined by the withdrawing opening and a servicing opening as well as by a closed air impermeable bottom and ceiling wall there is respectively provided an evaporator cell having respectively associated therewith an evaporator or a group of evaporators. Within the region of the withdrawal opening and the servicing opening, the evaporator cells are provided with at least partially aligned air inlet and outlet openings in such a way that the cooling air current in the vicinity of one end of the display chamber designed as freezing chamber is divided in such a way that one portion of the cooling air current serves for freezing the food and/or edible products whereas another portion of the cooling air current serves for creating a cooling barrier at the withdrawal opening, both portions of the cooling air current reuniting in the vicinity of the other end of the display cabinet.

17 Claims, 3 Drawing Figures

SELF-SERVICE COOLING CABINET

Low temperature chests for easily spoilable food and other edible products designed as self-service or low cooling chests have at the front side or top side thereof an easily accessible withdrawal opening in order to reach the desired goods. In order to prevent warm, humid air from the surrounding of the low temperature cooling chest from entering the said opening into the cooling chamber, it is customary, adjacent said withdrawal opening to provide an air barrier comprising as a rule a separate cooling unit commprising an evaporator and a ventilator, in addition to the cooling unit for the goods to be cooled. By means of said air barrier, the cooling losses are avoided by the discharge of cold air from the low cooling chest through said withdrawal opening, or are at least considerably reduced (German Auslegeschrift 12 91 342). For freezing baked goods, a refrigerator has become known the cooling chamber of which is arranged about centrally and can be produced with a low overall height in such a way that in the upper region on one side of the cooling chamber a recirculated air unit is provided the cooling current of which acts upon the upper section of the cooling chamber, whereas in the lower region on the other side of the cooling chamber there is provided another recirculated air unit the cooling current of which acts upon the lower section of the cooling chamber. Both recirculated air units are combined to a common air circuit. An arrangement of this type has become known by German Gebrauchsmuster 70 35 405.

The present invention relates to a self-service low cooling chest for easily spoilable food and/or edible products, especially ice cream, with a withdrawal opening easily accessible from the front, and with two cooling units which comprise a ventilator and an evaporator and which convey the air in a circuit over the goods to be cooled and subsequently return the air to the evaporators of the cooling units or groups of cooling units.

It is an object of the present invention to so arrange the air exit and air inlet openings of the two evaporator cells that these cells, with the low cooling chest equipped with a front withdrawal opening, will take care of an intensive cooling of the goods to be cooled and also will form a sufficient air barrier at said withdrawal opening.

It is a further object of this invention to provide a self-service cooling chest or cabinet of the type set forth in the preceding paragraph which will avoid the arrangement of a separate evaporator or of separate air passages for producing the air barrier or the like which closes toward the outside.

These and other objects and advantages of the invention will appear more clearly from the following specification in connection with the accompanying drawings, in which.

Figure 1:
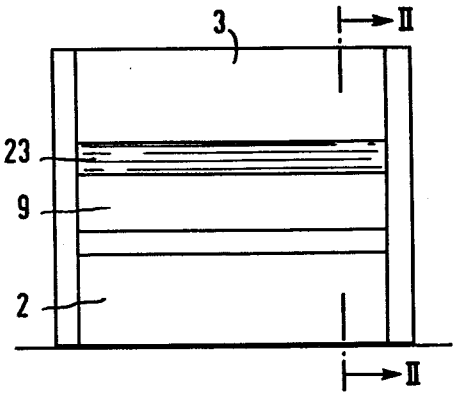
FIG. 1 illustrates a front view of a self-service low cooling chest according to the invention, with the chest designed as a unit to be placed on a table or counter.

The above outlined objects have been realized with a self-service low cooling chest of the above mentioned type by the fact that above and below the display chamber confined by the withdrawal opening and a service opening as well as by a closed air impermeable bottom and ceiling wall, there are respectively provided a evaporator cell each having an evaporator group. The evaporator cells are within the region of the withdrawal and removing opening provided with air inlet and outlet openings which at least partially are aligned with each other.

By so arranging the air inlet and outlet openings of the evaporator cells within the region of the withdrawal and removal openings that the air inlet and outlet openings are at least partially in alignment with each other or at least partially cover each other when placed upon each other, it will be assured that the two evaporators or evaporator groups supplement each other as to their operation so that a distinctive air barrier is provided against any material losses in cold air at the removal opening. At the same time, sufficient portion of the cooling current can be branched off from the circulating air current at the withdrawal or servicing opening for direct cooling of the goods to be preserved.

It is advantageous when the air exit opening of the upper evaporator cell has a wider exit cross section than the air inlet opening of the lower evaporator cell so that a portion of the cooling air leaving the upper evaporator cell impacts upon the air impermeable bottom plate of the lower evaporating cell and by the latter or an impact plate arranged there, is conveyed over the food or edible products. Therefore, the air impermeable bottom wall which is present anyhow will suffice to branch off a sufficient portion of the cooling air for directly cooling the food and/or edible products to be cooled. This effect can still be improved by suitably designed and correspondingly arranged air deviating or impact plates.

If a continuous control of the ratio of the quantity of air to the direct cooling of the food and/or edible products to be cooled and the quantity of air for maintaining the air barrier closing off to the outside is desired it is advantageous when the exit cross section of the air outlet of the upper evaporator cell is variable by slides, valves or the like.

For improving the servicing ease and for maintaining a sufficient air barrier, it is advantageous when the upper housing wall section of the front wall is inclined with regard to the longitudinal axis of the low cooling cabinet and is provided with a protective umbrella extending over the outer contour of the lower housing section of the front wall. The heat protective umbrella arranged on the free end face of the upper housing wall section of the front wall, which heat protective umbrella may have the form of a downwardly curved hood the free bottom edge of which covers up about the upper third of the servicing opening, represents a further protection against accidental entry of hot air or humid air into the inner chamber of the self-servicing low cooling cabinet.

Figure 3:
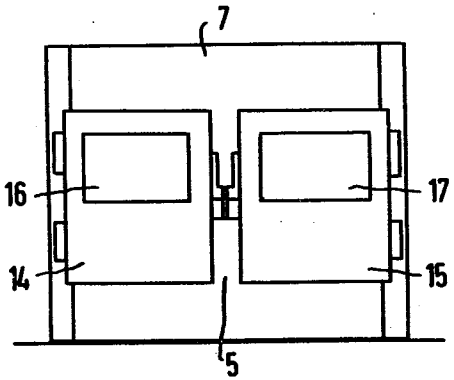
FIG. 3 is a rear view of the self-service low cooling chest according to FIG. 1.
Figure 2:
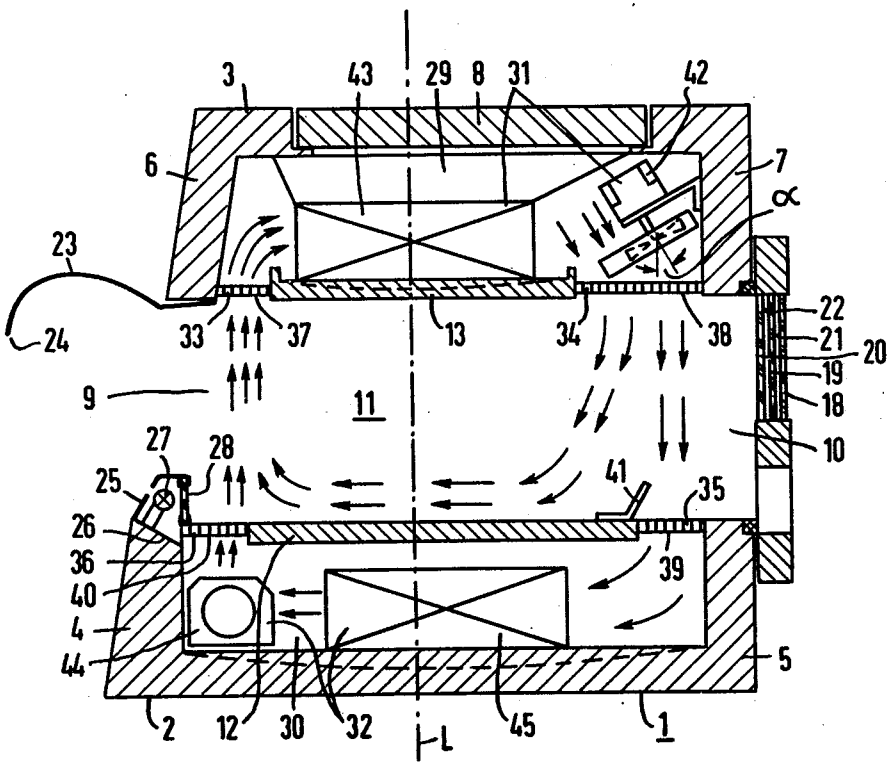
FIG. 2 shows on a larger scale than FIG. 1 a longitudinal section through the self-service low cooling chest according to FIG. 1, said section being taken along the line II—II of FIG. 1.

Referring now to the drawing in detail, the self-service low cooled cabinet 1 of FIGS. 1-3 comprises a lower housing section 2 and an upper housing section 3. The housing section 2 comprises an upwardly conically tapering front wall 4 and a rear wall 5 with uniform wall thickness. The upper housing part 3 comprises a front wall 6 which is inclined with regard to the longitudinal axis L of the device and furthermore comprises a rear wall 7 which is substantially parallel to said axis L. Between the front wall and the rear wall 6,7 of the upper housing part 3 is an insert 8 detachably inserted. The self-service low cooling cabinet 1 according to the invention comprises a withdrawal opening 9 freely accessible from the front, and also comprises a service opening 10 which is located opposite said opening 9. The display chamber 11 for the food and edible products to be cooled is in addition to the withdrawal opening 9 and the servicing opening 10 defined by a bottom wall 12 connected to the lower bottom part 2 and by a ceiling wall 13 connected to the upper housing part 3. The servicing opening 10 is preferably closed by two closable, pivotable doors 14, 15 as shown in FIG. 3. The pivotable doors 14, 15, similar to the housing parts 2,3 and 8 consist of a heat insulating material which may be of any known type. In order also within the window regions 16, 17 to obtain a sufficient heat insulation, the windows are preferably designed as double thermal panes with three glass elements 18, 19, 20 and with insulating space therebetween. In order to prevent a freezing of the pivotable doors 14, 15 at the rear walls 5,7 of the housing, the pivotable doors may be provided with heating means (Stockrahmenbeheizung). More specifically, the said heating means are adapted so to pre-heat the hinged or service doors 14, 15 that the temperature of the door frame within the region of the outside of the cooling cabinet 1 amounts to about 0° C. thereby safely preventing the doors 14, 15 from icing up and freezing shut.

For facilitating the withdrawal of the cold food and/or edible products, in particular prepared ice cream cups, ice cream bowls or the like, it is advantageous when the front wall 6 of the upper housing part 3 is inclined with regard to the longitudinal axis L of the low temperature display cabinet 1, and is provided with a heat protective umbrella 23 which extends over the outer contour of the front wall 4 of the lower housing part 2. A sufficient protection against accidental in-flow of humid and hot air into the display chamber 11 is in particular obtained when the heat protective umbrella 23 is designed as a downwardly curved hood the free lower edge 24 of which covers up about the upper $\frac{1}{3}$ of the opening 9. The heat protective umbrella 23 may consist of synthetic material such as acrylic resin and may be screwed onto the end face of the front wall 6 of the upper housing part 3. As further protection against accidental escape of cooling air, the front wall 4 of the lower housing part may be extended upwardly by about from 30–60 mm relative to the closed bottom wall 12 of the display chamber 11. The upwardly directed portion 25 of the front wall 4 of the lower housing part 2 may be folded upwardly from one piece with the front wall 4. The space obtained by the forwardly extending part 25 may expediently be closed in downward direction by means of a carrier plate 26 for an illuminating device 27. The light emitted by the illuminating device 27 passes preferably through a light permeable acrylic resin plate 28 into the display chamber 11 in order to even better show the display chamber 11. The closed ceiling wall 13 may be provided with a mirror (not shown) which is directed toward the food and edible products to be cooled.

It is important for the invention that above and below the display chamber 11 which is defined by the openings 9 and 10 and the closed bottom and ceiling wall 12, 13, there are respectively provided an evaporation cell 29, 30 with a cooling unit 31, 32 comprising a ventilator and evaporator, or there is provided a cooling unit group comprising a plurality of cooling units. The evaporator cells 29,30 are within the region of the openings 9 and 10 provided with an air inlet and outlet opening 33,34; 35,36. The air conveying openings 33–36 are confined relative to the display chamber 11 by air guiding grates 37–40 preferably of hard polyvinylchloride. A sufficient cooling of the low cooling chest 1 is effected by the cooling units 31, 32 or cooling unit groups composed of a plurality of cooling units. The cooling units or group of cooling units respectively comprise a ventilator 42 and an evaporator 43 in the upper evaporator cell 29 and ventilator 44 and evaporator 45 in the lower evaporator cell 30. The ventilator 42 arranged in the upper evaporator cell 29 is preferably designed as axial ventilator and is inclined with regard to the longitudinal axis L of the low cooling chest 1 at an angle $\alpha$ of from 20–40°, preferably of 30°. In order to assure an effective cooling effect, the axial ventilator 42 is preferably arranged at the air exit opening 34 of the upper evaporator cell 29. For purposes of increasing the forced ventilation, it is also possible at the air entrance opening 33 of the upper evaporator cell 29 to provide an axial ventilator arranged in a corresponding manner.

The lower evaporator cell 30, preferably within the region of the air exit opening 36, comprises a ventilator designed as transverse current blower 44. A corresponding ventilator may also be provided at the air inlet opening 35. The evaporators 43,45 may preferably be designed as double evaporators known per se.

The operation of the self-service low cooling cabinet according to the invention is as follows: after the cooling units 31, 32 comprising ventilator and evaporator have been started, the air drawn in by the axial ventilator 42 in the upper evaporator cell 29 passes into the display chamber 11 through the air exit opening 34. A portion of the cooling air passing through the air exit opening 34 with relatively large opening cross section, flows through the air inlet opening 35 into the air opening evaporator cell 30, is cooled on the evaporator 45 to −6° down to −12°, is enlarged with the air humidity required for the ice cream, and passes through the transverse current below 44 through the air exit opening 36 into the region of the withdrawal opening 9. The air current flowing from the air exit opening 36 in the lower evaporator cell 30 to the air inlet opening 33 in the upper evaporator cell 29 forms in cooperation with the heat protective umbrella 23 a sufficient air barrier against the entry of warm humid air from the surroundings of the low cooling chest. After the air passes through the air inlet opening 33 and the upper evaporator cell 29, the air is conveyed through the evaporator 43, where it cools off, and thereupon passes eventually through the axial ventilator 42 and through the air exit opening 34 of the upper evaporator cell 29 again into the region of the display chamber 11. In this connection, a portion of the air impacts upon the bottom plate 12 projecting over the exit opening 34, or impacts upon an impact plate 41 arranged adjacent thereto. In this way, the air is deviated and passes into the region of the food or edible products to be cooled. Subsequently, the major portion of this cooling air passes through the air inlet opening 37 into the upper evaporator cell 29 where it again is cooled by the evaporator 43. The ratio of the air current passing through the inlet 35 to the air current to be deviated by the impact plate 41 or the bottom plate 12 can be controlled by valves, slides or the like mounted in the exit cross section of the air exit opening 34 in the upper evaporator cell 29. From the above description of the individual cooling elements and their arrangement relative to each other, it is evident that it is possible to obtain a common air circuit for cooling the food and edible products on one hand and for forming an air barrier at the opening 9 on the other hand. In this connection, it is advantageous so to arrange the cooling units 31, 32 that the cooling air current is passed around the food and/or edible products to be cooled within the region of the opening 9 from below in upward direction. This is of importance in particular for the main employment of the invention, namely for the long-term preservation of ice cream in cups or bowls. As numerous tests have shown, it is possible with the self-sevice low cooled cabinet according to the invention to preserve ice cream over period of from 10–12 hours and longer. The obtainable cabinet permanent temperature may amount down to −12°. This is sufficient to preserve over many hours soft ice cream as well as hard ice cream without adding any additives which are sometimes undesirable.

It is, of course, to be understood that the invention can also be employed for other types of food and edible substances, especially for the preservation of regular ice creams, fruit ice cream cups, fruit cream cups, yogurt cups, whipped cream cups and the like, while the recirculated air temperature is set accordingly.

The present invention brings about the great advantage that in particular ice creams, ice cream cups and the like can now be pre-portioned ready for serving over a period of a plurality of hours and can be readied for consumption without packaging and can be withdrawn without mechanical closure from the front of the low cooling cabinet. The heretofore known technical solution required a packaging so that the withdrawal was possible only by chest-like devices after actuating mechanical closure elements. This is completely obviated by the device according to the invention. The withdrawal is freely accessible. The chest is opened at the withdrawal side. A further advantage of the device according to the invention consists in that the goods are freely visibly offered to the prospective consumer without a fogged-up pane. These advantages are furthermore increased by economical effects which are due to the fact that in view of the pre-portioning of the ice cups or ice balls, waiting times are no longer necessary and also servicing personnel is not required. The sales prospects are greatly improved because a relatively great selection of specialties are offered to the consumer in a clearly visible and attractive manner.

It is important that, as bacteriological tests conducted with different samples have proved, all tests showed that these samples were germ- or bacteria-free which means that all samples were sterile—in other words, free from bacteriological impurification.

It is, of course, to be understood that the present invention is, by no means, limited to the specific showing in the drawing, but also comprises any modifications within the scope of the appended claims.

What we claim is:

1. A self-service low temperature cooling cabinet for easily spoilable food and edible products, which includes: a housing having a lower section and an upper section, and also having a front wall with an easily accessible front withdrawal opening and a rear wall opposite and in spaced relationship to said front wall and provided with a servicing opening, an air impermeable bottom wall connected to said lower section of said housing, a ceiling wall connected to said housing upper section and arranged opposite and in spaced relationship to said bottom wall, said front and rear walls together with said bottom and ceiling walls defining a display chamber, evaporating cells comprising evaporator means respectively provided above and below said display chamber for generating cooling air currents, said evaporator means above said display chamber being within the region of said withdrawal opening and within the region of said servicing opening respectively provided with an air inlet and an air outlet, and said evaporator means below said display chamber being within the region of said withdrawal opening and within the region of said servicing opening respectively provided with an air outlet and an air inlet, said air outlet of said evaporator means below said display chamber being at least partially in alignment with said air inlet of said evaporator means above said display chamber, and said air outlet of said evaporator means above said display chamber being at least partially in alignment with said air inlet of said evaporator means below said display chamber, said at least partially aligned inlets and outlets of said evaporator means above and below said display chamber respectively being so arranged that the cooling air current in the vininity of one end of said display chamber splits up so that one portion of said cooling air current serves for freezing any food and edible products in said display chamber whereas another part of said cooling air current serves for creating an air barrier at said withdrawal opening, said two parts of cooling air currents being adapted to unite again in the vicinity of the other end of said display chamber.

2. A cooling cabinet according to claim 1, in which the air outlet of said upper evaporating cell has a greater exit cross section than said air inlet at least partially aligned therewith and pertaining to said lower evaporating cell whereby a part of the cooling air emitted by said upper evaporating cell is directed onto said air permeable bottom wall, and by the latter is brought into contact with products to be cooled in said display chamber.

3. A cooling cabinet according to claim 2, in which said greater exit cross section of said air outlet of said upper evaporating cell approximately equals twice the cross section of the air inlet at least partially aligned with said last mentioned air outlet and pertaining to said lower evaporator cell.

4. A cooling cabinet according to claim 1, which includes control means associated with the cross section of said air oulet of said upper evaporating cell.

5. A cooling cabinet according to claim 1, in which said evaporator means of said upper and lower evaporating cells are so arranged as to generate a common air circuit for cooling said display chamber and for creating an air barrier at said withdrawal opening.

6. A cooling cabinet according to claim 5, in which said evaporator means are so arranged that the cooling air current is guided around the products in said display chamber in upward direction within the region of said withdrawal opening.

7. A cooling cabinet according to claim 1, in which said front wall includes a front portion forming part of said upper section and being inclined to the transverse axis of said display chamber so as to form an acute angle with said axis, and which includes a warm air protective umbrella associated with said front portion and projecting away from said display chamber beyond the outer contour of said front wall.

8. A cooling cabinet according to claim 7, in which said warm air protective umbrella has the shape of a downwardly curved hood having its free lower edge extending up to the end of the upper third of said withdrawal opening.

9. A cooling cabinet according to claim 1, which includes insulated pivotable glass doors associated with said servicing opening for closing the latter.

10. A cooling cabinet according to claim 9, which includes heating means (Stockrahmenbeheizung) and in which said insulated glass door is heatable by said heating means.

11. A cooling cabinet according to claim 1, in which said front wall has a wall portion forming part of said lower housing section and projecting upwardly beyond said bottom wall for supporting an illuminating device.

12. A cooling cabinet according to claim 1, which includes a mirror mounted on said ceiling wall so as to face said bottom wall.

13. A cooling cabinet according to claim 1, in which said upper evaporating cell houses at least one axial ventilator having its longitudinal axis inclined forming with the transverse axis of said display chamber an angle of from 20° to 40°.

14. A cooling cabinet according to claim 13, in which said angle formed by said longitudinal axis of said at least one axial ventilator with the transverse axis of said display chamber amounts to about 30°.

15. A cooling cabinet according to claim 13, in which said axial ventilator is arranged at the air outlet of said upper evaporating cell.

16. A cooling cabinet according to claim 1, which includes at least one transverse current blower arranged in said lower evaporating cell.

17. A cooling cabinet according to claim 16, in which said at least one transverse current blower is arranged at the air outlet of said lower evaporating cell.

* * * * *